US006474342B1

(12) United States Patent
Rennecamp

(10) Patent No.: US 6,474,342 B1
(45) Date of Patent: Nov. 5, 2002

(54) SMOKING APPARATUS AND ASSEMBLY THEREOF

(76) Inventor: Bryan Rennecamp, 5621 Delmar Ave., Apt. 812, St. Louis, MO (US) 63112

( * ) Notice: Subject to any disclaimer, the term of this patent is extended or adjusted under 35 U.S.C. 154(b) by 0 days.

(21) Appl. No.: 09/558,758

(22) Filed: Apr. 21, 2000

Related U.S. Application Data

(60) Provisional application No. 60/130,850, filed on Apr. 22, 1999.

(51) Int. Cl.[7] ..... A24F 23/00; B65D 85/00; B65D 43/00

(52) U.S. Cl. ..... 131/241; 131/242; 131/257; 206/242; 220/345.1; 220/810; D27/186; D27/187; D27/189

(58) Field of Search ..... 131/237.5, 240.1, 131/241, 242, 257; 206/242, 246, 244; 220/505, 555, 354.1, 351, 810; D27/186, 188, 189, 187

(56) References Cited

U.S. PATENT DOCUMENTS

| | | | | | |
|---|---|---|---|---|---|
| 498,695 | A | * | 5/1893 | Powell | |
| 842,065 | A | * | 1/1907 | Bherman | |
| 1,444,308 | A | * | 2/1923 | Dunning | |
| 1,616,436 | A | * | 2/1927 | Bird | |
| 1,706,244 | A | * | 3/1929 | Meyerson | |
| 1,840,664 | A | * | 1/1932 | Gerstheimer | |
| 1,927,092 | A | | 9/1933 | Howard | |
| 2,000,920 | A | * | 5/1935 | Campbell | |
| 2,245,798 | A | * | 6/1941 | May | |
| 2,506,385 | A | | 5/1950 | Roamer | 206/48.5 |
| 3,233,951 | A | | 2/1966 | Deal | 312/31.2 |
| 3,861,523 | A | | 1/1975 | Fountain et al. | 206/236 |
| 4,207,976 | A | | 6/1980 | Herman | 206/246 |
| 4,214,658 | A | | 7/1980 | Crow | 206/244 |
| 4,793,478 | A | | 12/1988 | Tudor | 206/256 |
| 5,277,304 | A | | 1/1994 | Brizzi et al. | 206/256 |
| 5,465,738 | A | * | 11/1995 | Rowland | |
| 5,711,423 | A | * | 1/1998 | Fuller | |
| 5,810,164 | A | | 9/1998 | Rennecamp | 206/256 |
| 5,848,596 | A | * | 12/1998 | Zelenik | |
| 5,967,310 | A | * | 10/1999 | Hill | |
| 5,967,312 | A | * | 10/1999 | Jacobs | |
| D416,106 | S | * | 11/1999 | Rennecamp | D27/189 |
| 6,070,591 | A | * | 6/2000 | Bryer | 131/233 |

FOREIGN PATENT DOCUMENTS

| | | | |
|---|---|---|---|
| GB | 2236737 | * | 4/1991 |

* cited by examiner

*Primary Examiner*—Steven P. Griffin
*Assistant Examiner*—Carlos Lopez
(74) *Attorney, Agent, or Firm*—Senniger, Powers, Leavitt & Roedel

(57) ABSTRACT

A smoking apparatus including a smoking insert and a smoking apparatus body; the smoking insert has a smoking material receptacle for holding loose smoking material and a pipe receptacle for holding a pipe; the smoking apparatus body has a first chamber for receiving the smoking material receptacle and a second chamber for receiving the pipe receptacle.

11 Claims, 23 Drawing Sheets

SMOKING APPARATUS AND ASSEMBLY THEREOF

This application claims priority from U.S. provisional patent application 60/130,850 filed Apr. 22, 1999.

BACKGROUND OF THE INVENTION

This invention relates to a smoking apparatus and, more particularly, to an apparatus which holds one or more smoking pipes and loose smoking material. The invention also relates to a method for assembling a smoking apparatus.

Most smoking systems designed to hold a smoking pipe and smoking material are relatively intricate and bulky, making them difficult to manufacture using common plastic injection molding techniques.

U.S. Pat. Nos. 4,214,658 and 5,465,738 disclose smoking systems in which a pipe is moved into accessible position by means of a resilient element when its cover is slid to the side. U.S. Pat. No. 5,810,164 discloses a smoking system adapted to fit snugly within a cigarette box. The configuration of these prior designs does not facilitate manufacture by plastic injection molding.

SUMMARY OF THE INVENTION

It is an object of this invention to provide a smoking system which is simple and economical to manufacture by common plastic injection molding techniques. It is a further object to provide a smoking system which renders filling of a pipe with smoking material simple. A still further object is to provide such a system in which there is a reduced risk of mishandling the pipe and spilling of smoking material.

Briefly, therefore, the invention is directed to a smoking apparatus of the type having a space for holding loose smoking material and a separate space for holding an elongate smoking pipe. There is a smoking insert having a smoking material receptacle for holding loose smoking material and a pipe receptacle for holding the pipe. The smoking material receptacle has a smoking material receptacle opening at the top thereof, a solid smoking material receptacle bottom, downwardly extending smoking material receptacle side walls, and a solid smoking material receptacle bottom. The pipe receptacle has a pipe receptacle opening at the top thereof, a solid pipe receptacle bottom, downwardly extending pipe receptacle side walls, and a solid pipe receptacle bottom. There is a smoking apparatus body for housing the insert having an external surface, an upper end, and a lower end.

In another aspect the smoking insert has an lip at its upper end adjacent its openings which rests on an upper end of the body when the insert is inserted into the body.

In a further embodiment, the smoking material receptacle side walls are tapered and have a width and depth to fit snugly within the first chamber of the apparatus body.

The invention is also directed to an embodiment in which the pipe receptacle side walls are tapered and have a width and depth to fit snugly within the second chamber of the apparatus body.

Still further the invention is directed to an embodiment in which the smoking apparatus body is tapered from its upper end to its lower end.

The invention is also directed to a smoking apparatus having a recess on the external surface of the body for receiving a label.

Still further, the invention is directed to a method for assembling a smoking apparatus of the type having a space for holding loose smoking material and a separate space for holding an elongate smoking pipe. A smoking insert having a smoking material receptacle for holding loose smoking material and a pipe receptacle for holding a pipe is inserted into a smoking apparatus body at the upper end of the smoking apparatus body.

Other objects and features of the invention will be in part apparent and in part pointed out below.

DETAILED DESCRIPTION OF THE INVENTION

Figure 1:
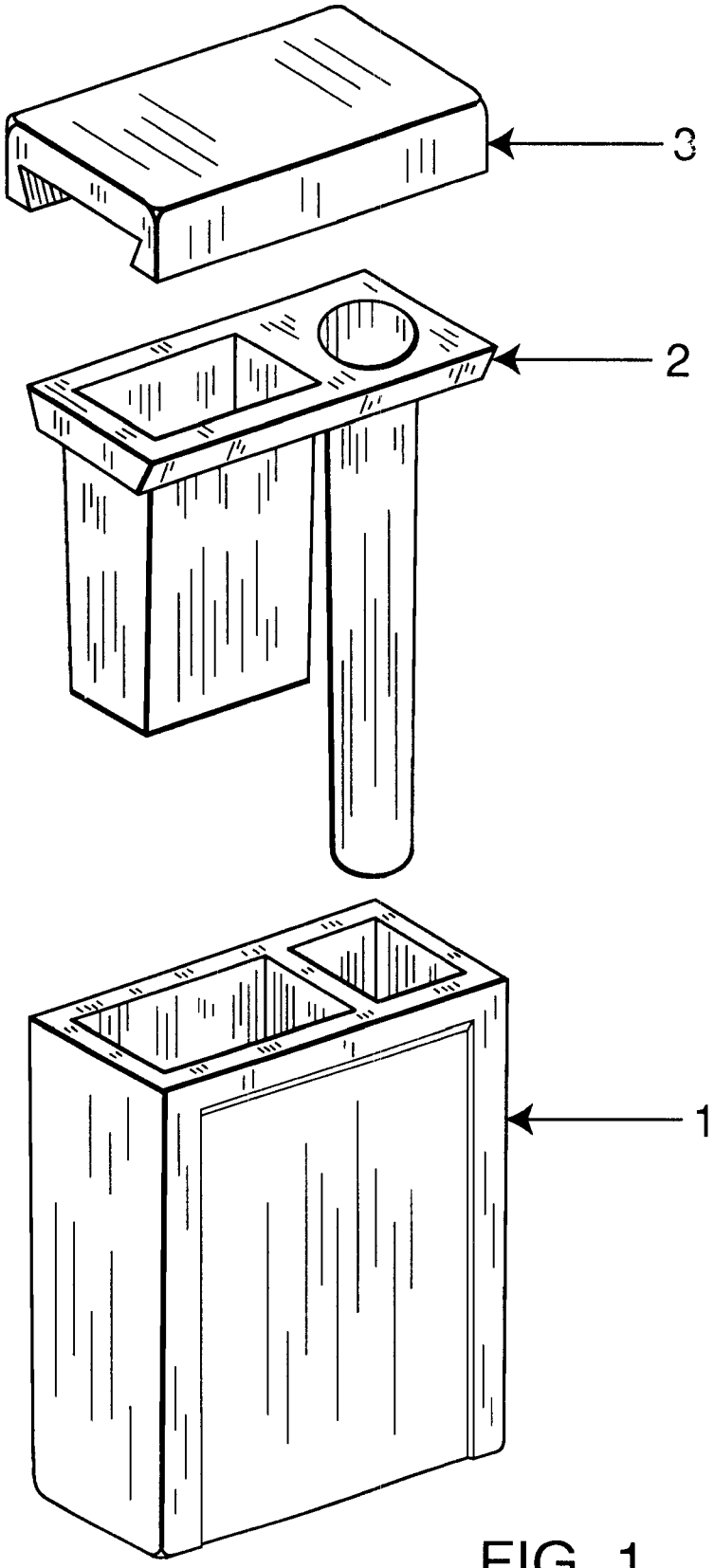
FIG. 1 is a perspective exploded view of the invention.

As shown in FIG. 1, the invention is a smoking apparatus having a smoking apparatus body 1, a smoking apparatus insert 2, and, in the preferred embodiment shown, a lid 3, all three of which are preferably molded from plastic, for example ABS plastic.

Figure 2:
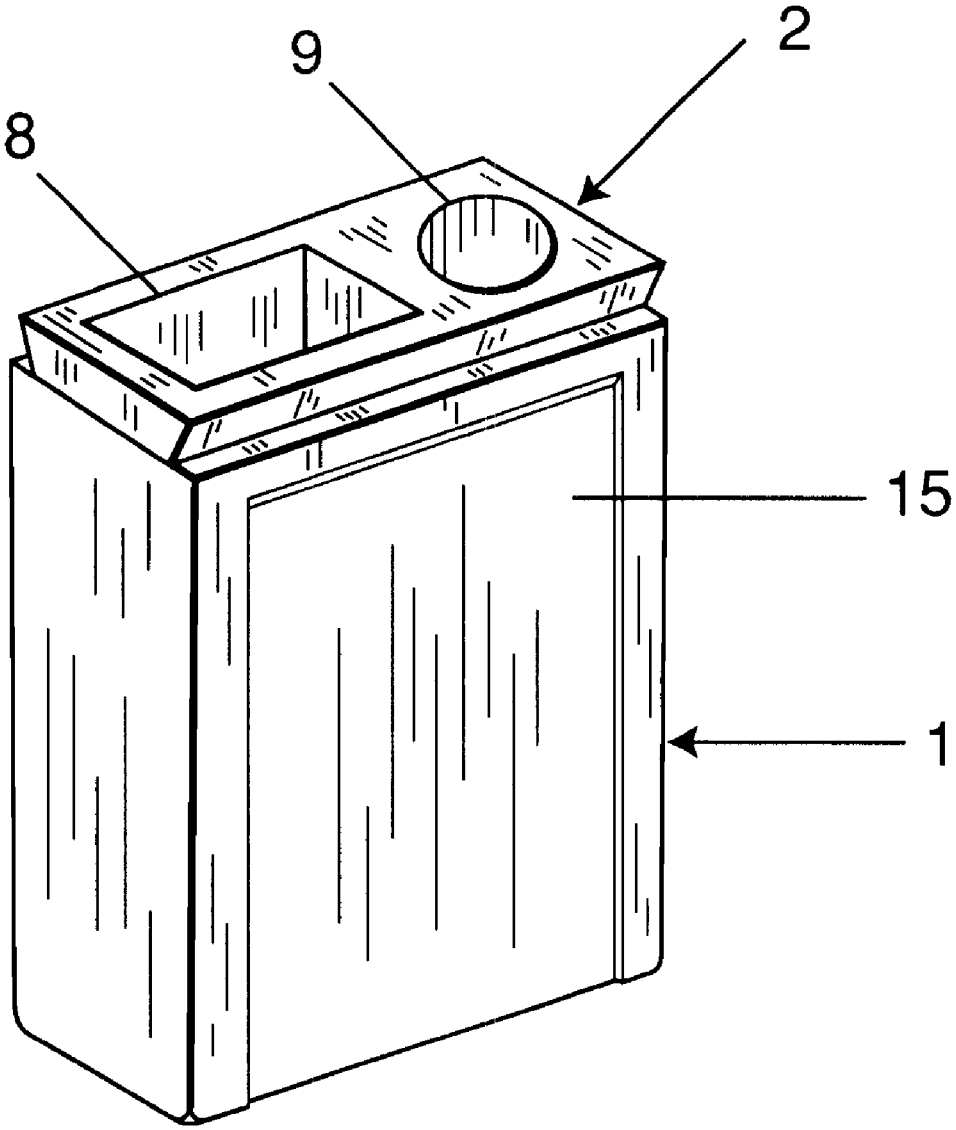
FIG. 2 is a perspective view of the invention.
Figure 3:
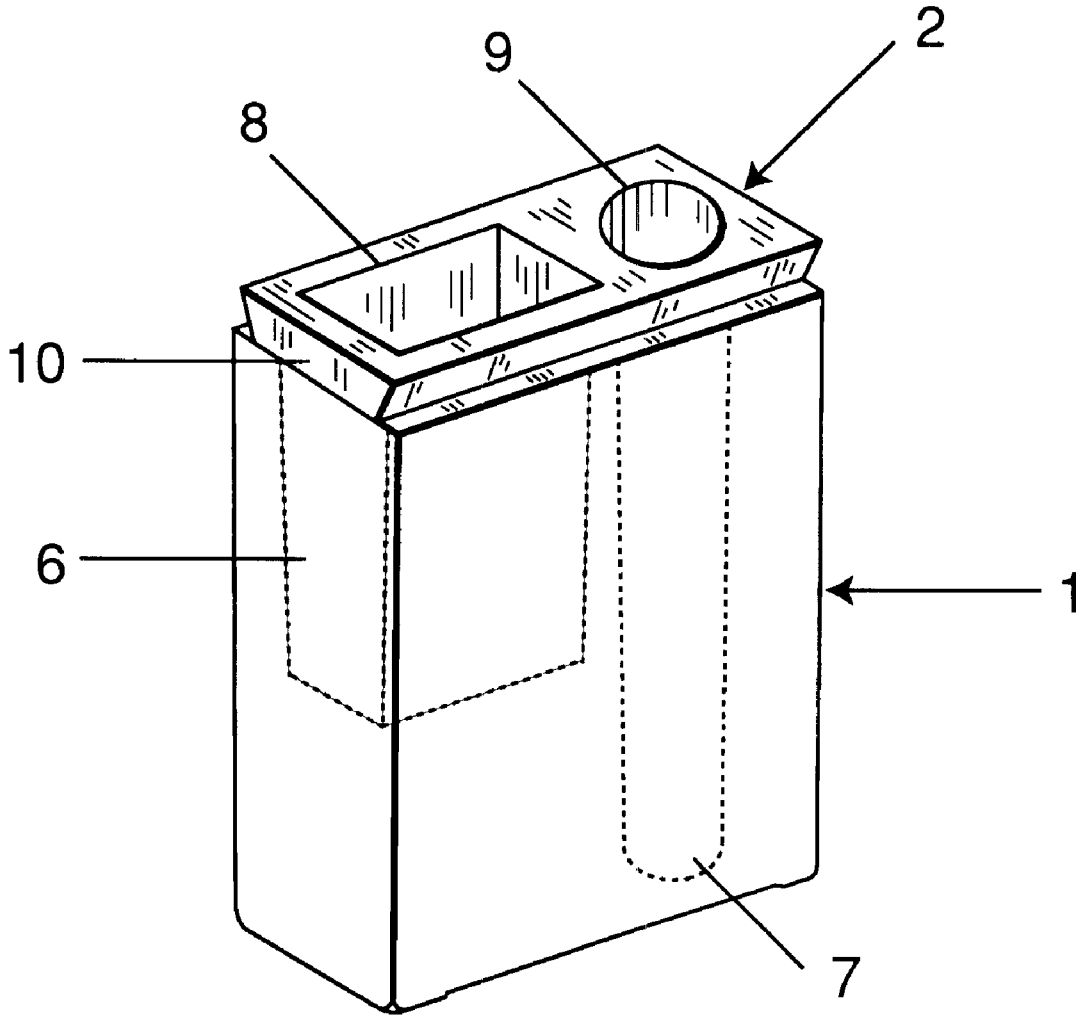
FIG. 3 is a perspective view of the invention showing its internal components in phantom.
Figure 4:
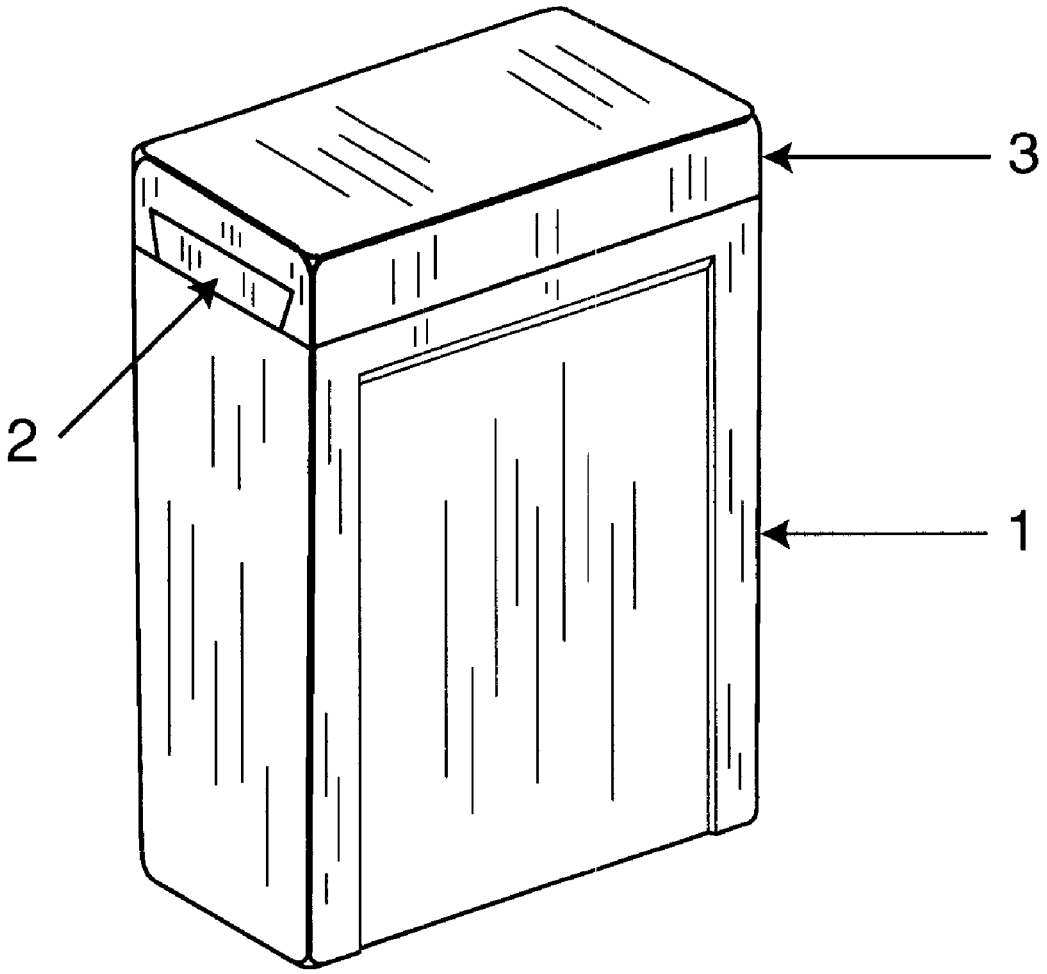
FIG. 4 is a perspective view of the invention with its lid applied in closed position.

FIG. 2 illustrates that the smoking apparatus insert 2, which fits inside body 1, includes a smoking material receptacle for holding loose smoking material, the smoking material receptacle having an opening at 8, and a pipe receptacle for holding a pipe, the pipe receptacle having an opening at 9.

Figure 7:
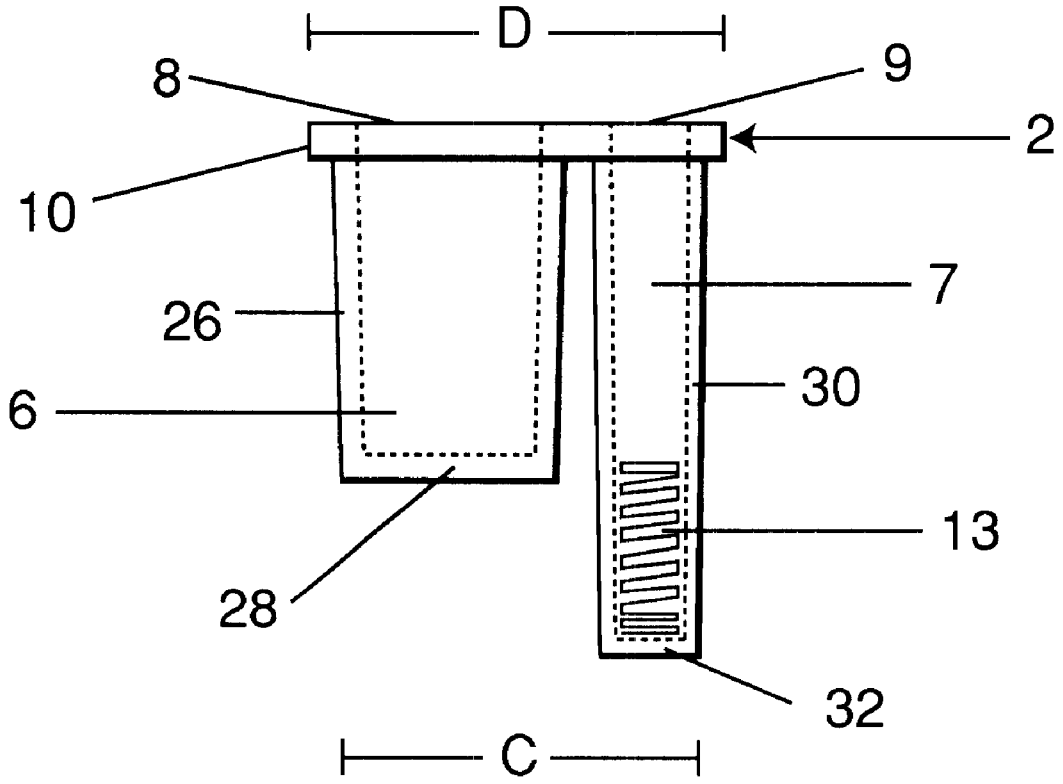
FIG. 7 is a front elevation of the insert component of the invention.

Turning to FIG. 7, the smoking insert 2 includes a smoking material receptacle 6 having opening 8, downwardly extending smoking material receptacle side walls 26, and a smoking material receptacle solid bottom 28. The insert also has a pipe receptacle 7 having opening 9, downwardly extending pipe receptacle side walls 30, and a solid pipe receptacle bottom 32. In the preferred embodiment shown the insert has an upper width D which is larger than a lower width C. The smoking material receptacle 6 and the pipe receptacle 7 are each preferably formed with a draft or taper from top to bottom to facilitate ejection of the insert from a mold upon forming as by, for example, plastic injection molding.

Figure 8:
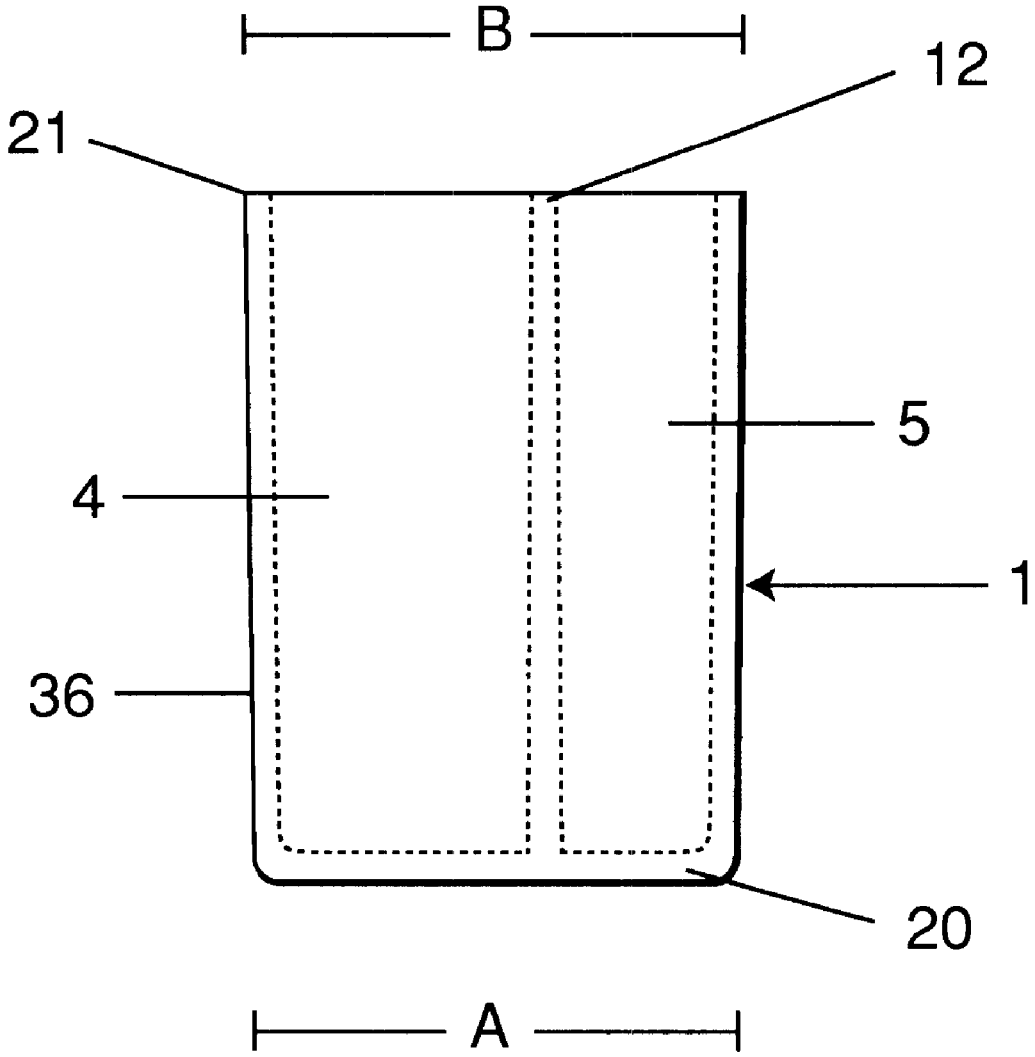
FIG. 8 is a front elevation of the smoking apparatus body component of the invention.
Figure 10:
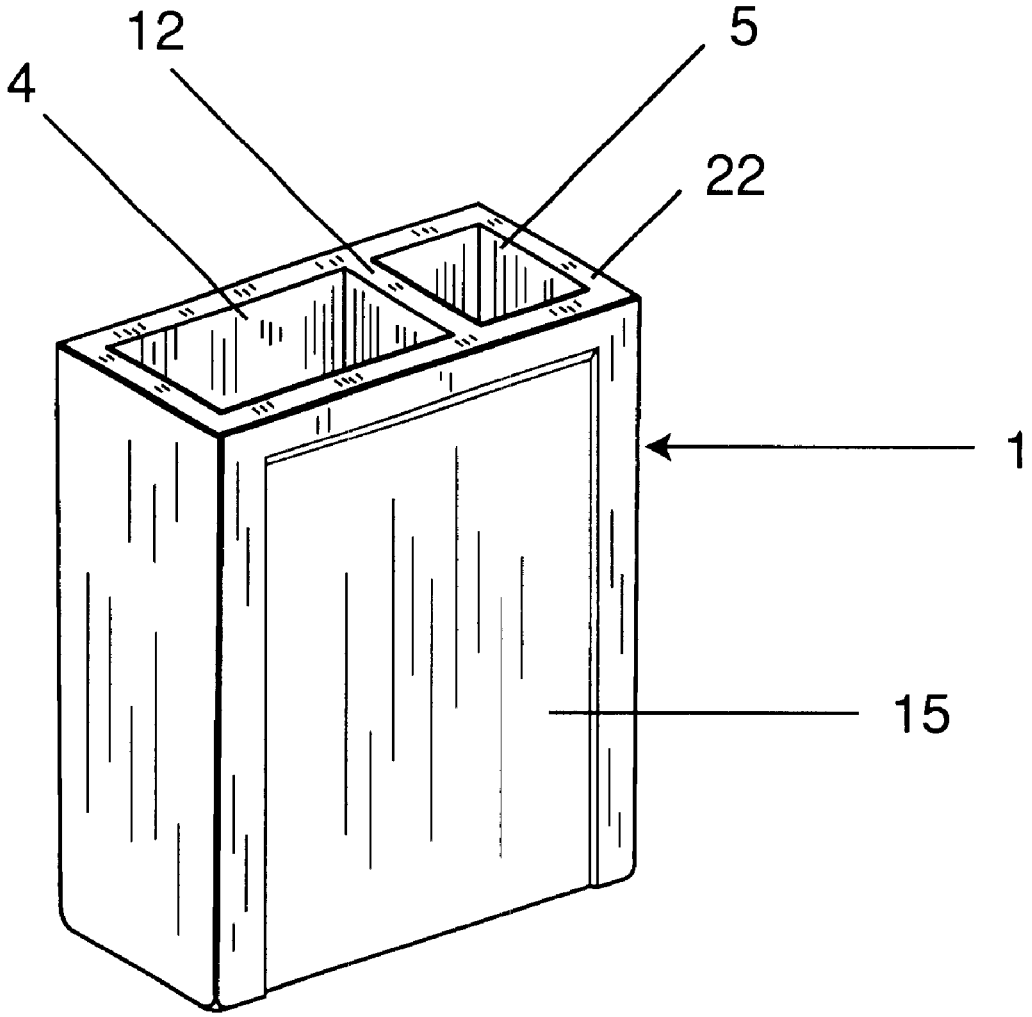
FIG. 10 is a perspective view of the smoking apparatus body component of the invention.
Figure 11:
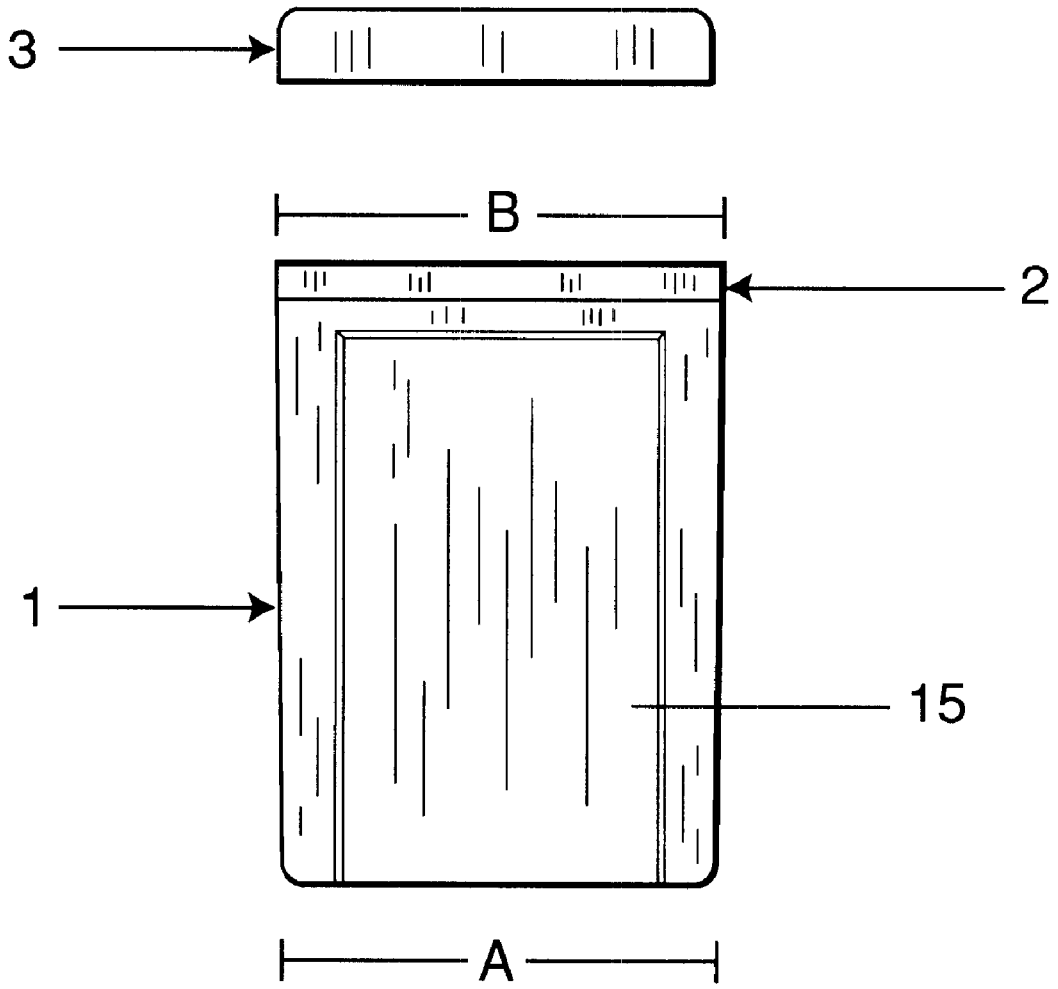
FIG. 11 is a front elevation of the invention.
Figure 12:
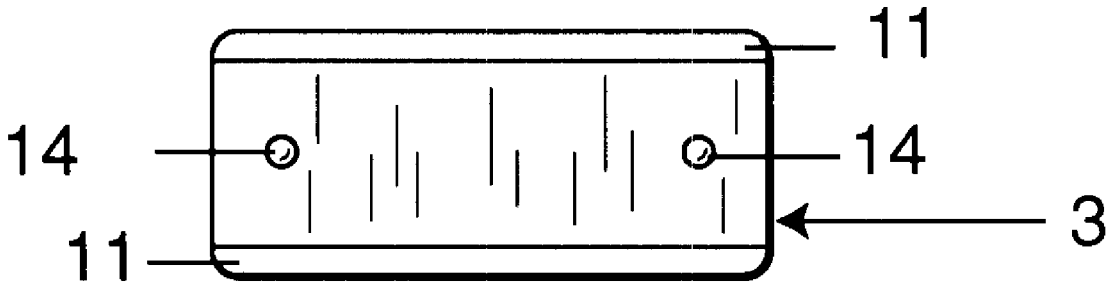
FIG. 12 is a bottom view of the lid component of the invention.
Figure 14:
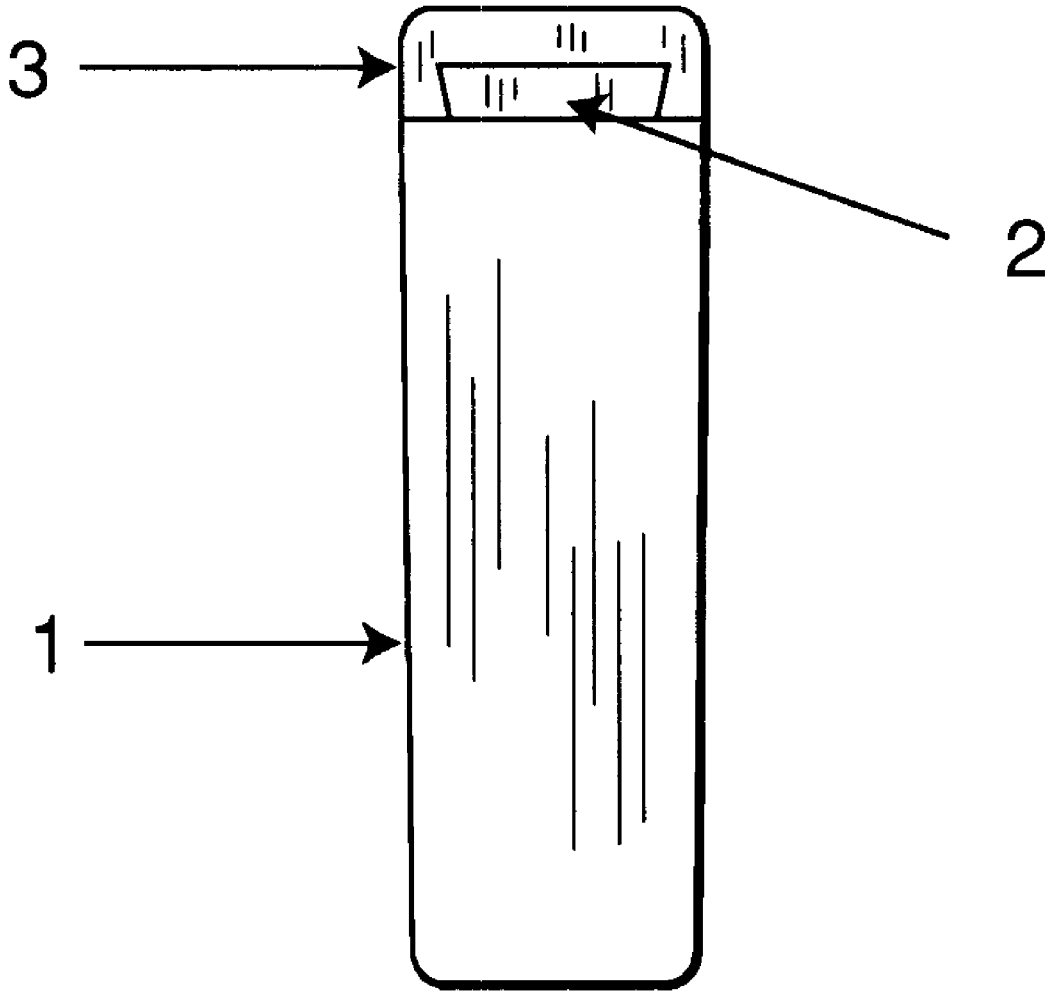
FIG. 14 is a right side elevation of the invention.

FIG. 8 illustrates that the smoking apparatus body 1 includes an external surface 36, a smoking apparatus body first chamber 4, a smoking apparatus body second chamber 5, and a smoking apparatus body divider 12 separating the first and second chambers. This body divider helps to upwardly support the smoking insert. The body has a lower end 20, and an upper end 21 with an upper rim 22 (FIG. 10). In the preferred embodiment shown the lower end 20 has a width A which is smaller than the width B of the upper end 21, such that the body is tapered from its upper end to its lower end. This taper characteristic adds to the ergonomic appeal of the apparatus when it is held by the smoker. This taper also facilitates molding because the body can be readily ejected from a mold upon forming. The chambers 4 and 5 are also preferably tapered from the upper end to the lower end to similarly facilitate molding. FIG. 14 illustrates that in the preferred embodiment the body 1 also includes an upper end depth F which is larger than a lower end depth E, such that the body is tapered from the upper end to the lower end to facilitate ejection of the body from a mold upon forming. The body also preferably has a recess 15 as shown in FIG. 2 on its external surface for receiving a printed adhesive label or the like. The recess provides that the label, when affixed, is flush with the front surface of the rest of the body. The bottom of the body may be open or may be solid. In the currently preferred embodiment the bottom is solid.

The smoking material receptacle external side walls are preferably tapered as shown in FIG. 7 and have a width and depth mating with the internal width and depth of the first chamber of the body 1, at least at an upper segment thereof, to facilitate a snug fit between the insert and the body. Similarly, the pipe receptacle side walls are preferably tapered to a smaller width G (FIG. 15) and have a width and depth mating with the internal width and depth of the second chamber of the body 1, at least at an upper segment thereof, to facilitate a snug fit between the insert and the body.

Figure 9:
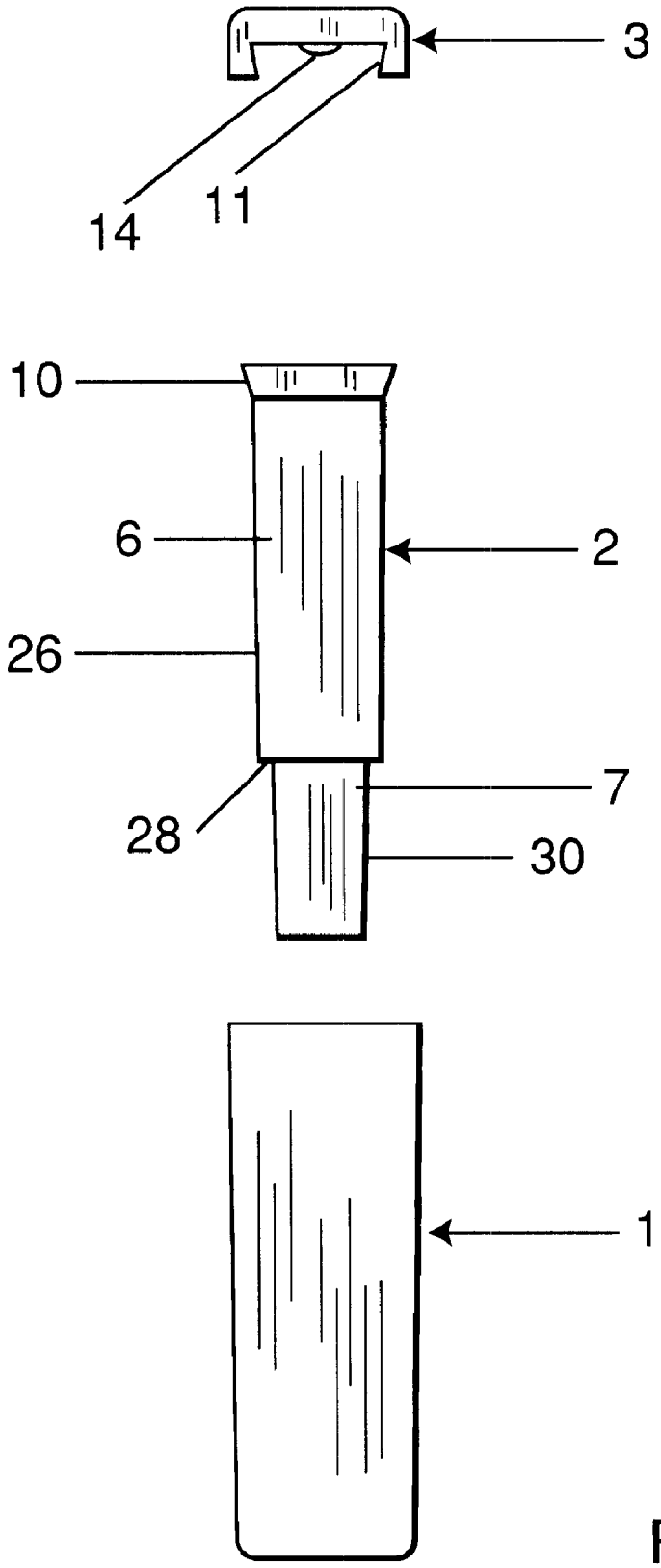
FIG. 9 is a left side exploded elevation of the invention.
Figure 15:
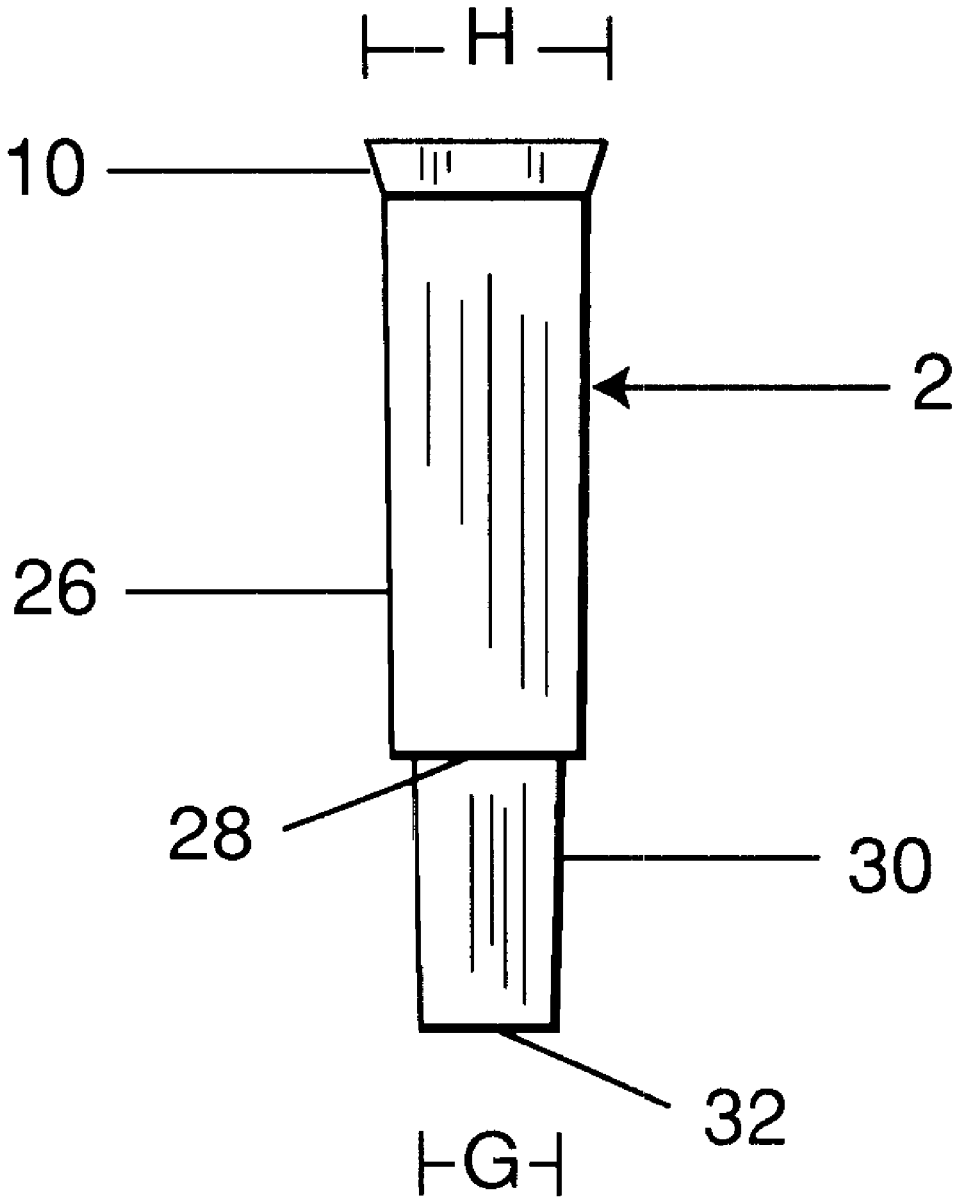
FIG. 15 is a left side elevation of the insert component of the invention.
Figure 16:
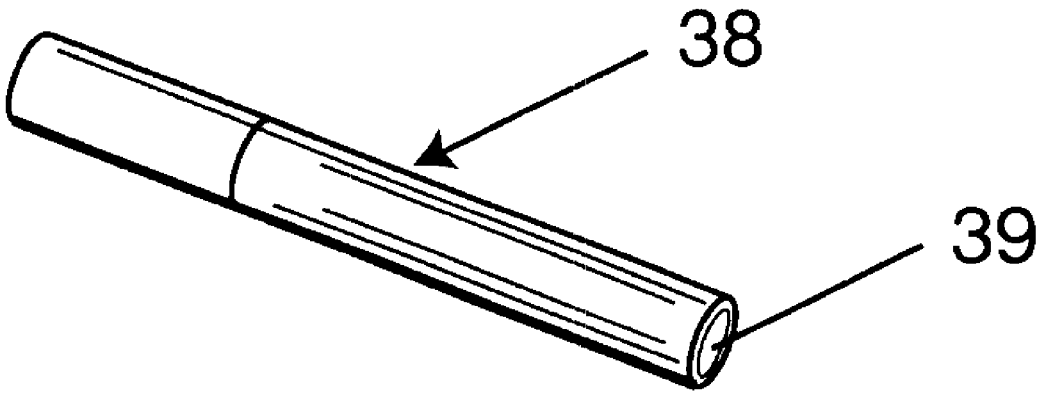
FIG. 16 is a perspective view of a pipe for use in conjunction with the invention.
Figure 17:
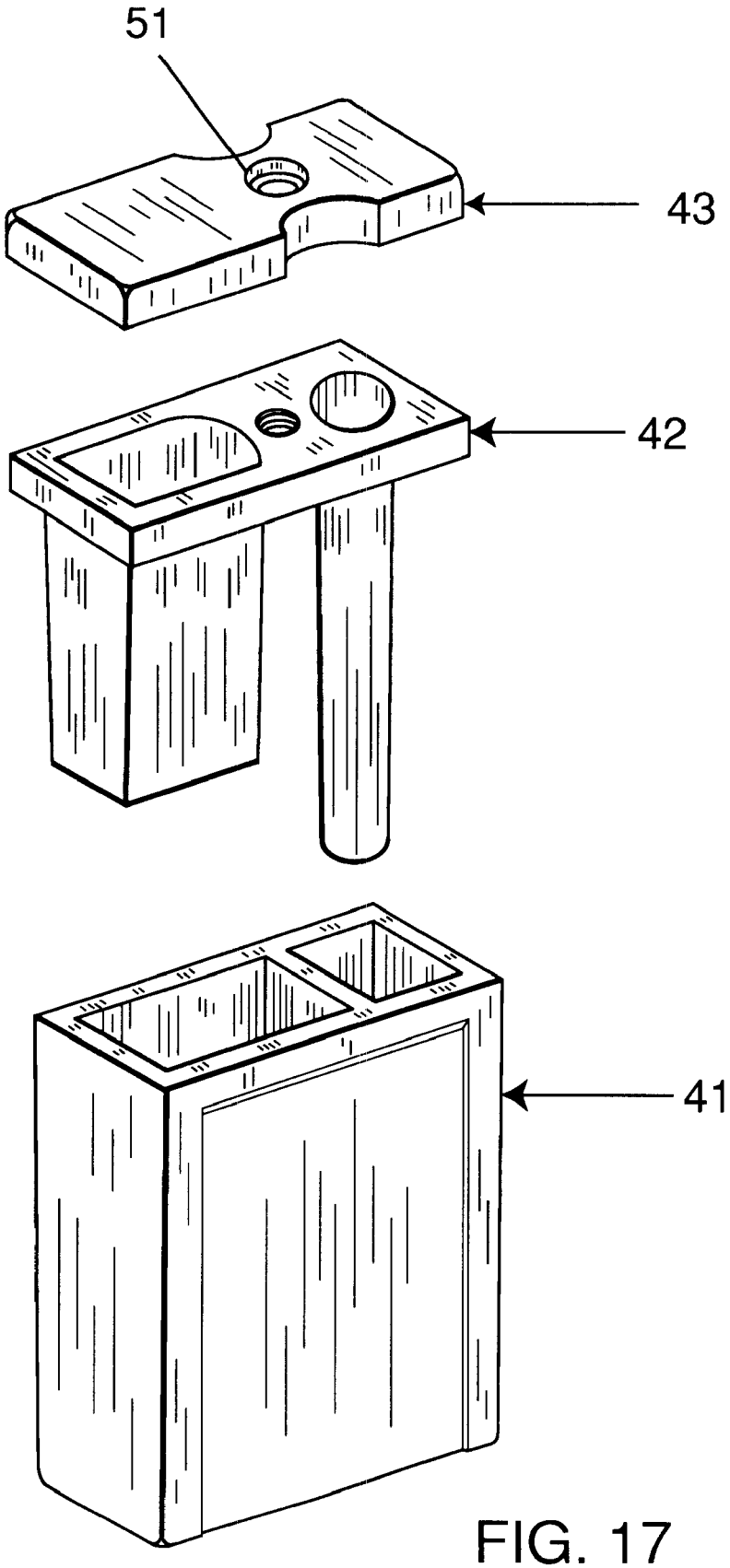
FIG. 17 is an exploded perspective view of an alternative embodiment of the invention.
Figure 18:
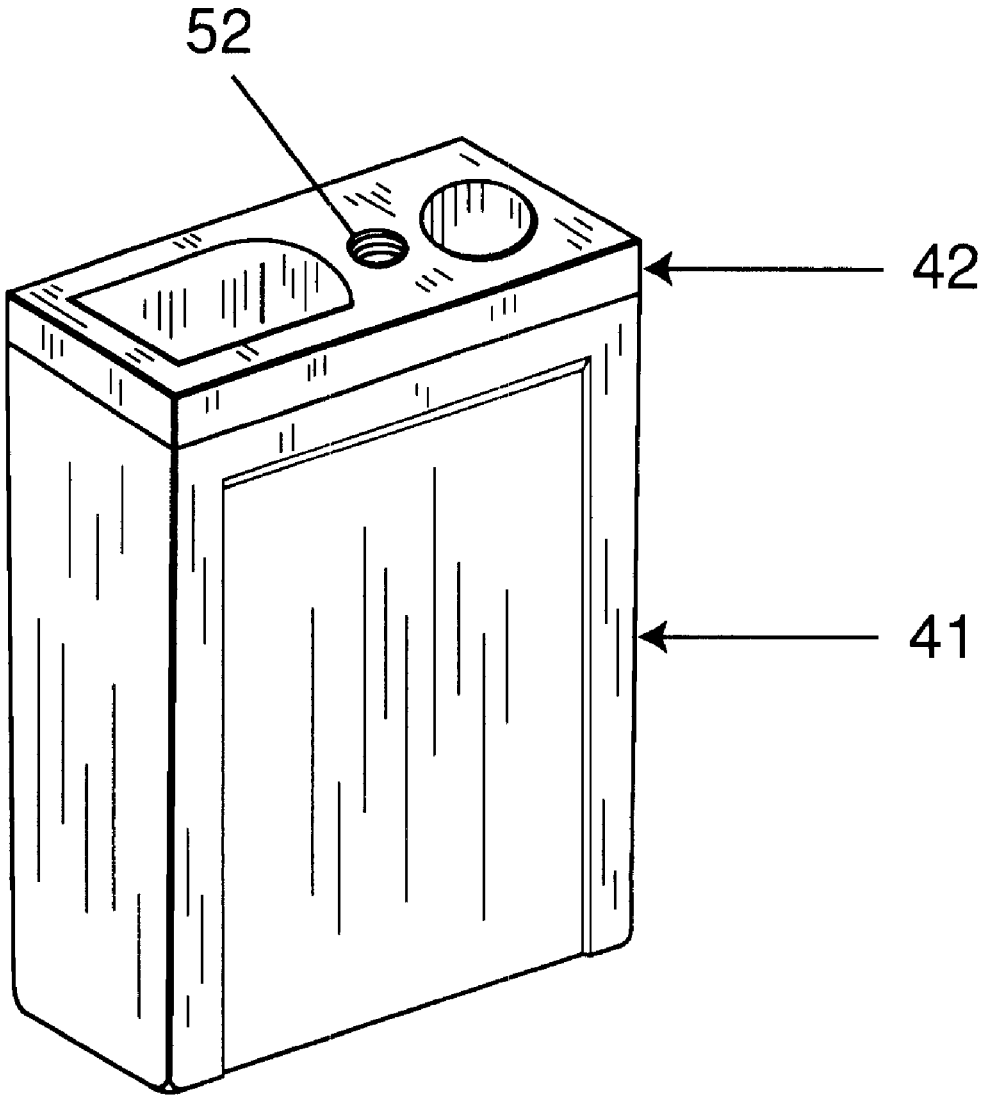
FIGS. 18, 19 and 20 are perspective views of an alternative embodiment of the invention.
Figure 19:
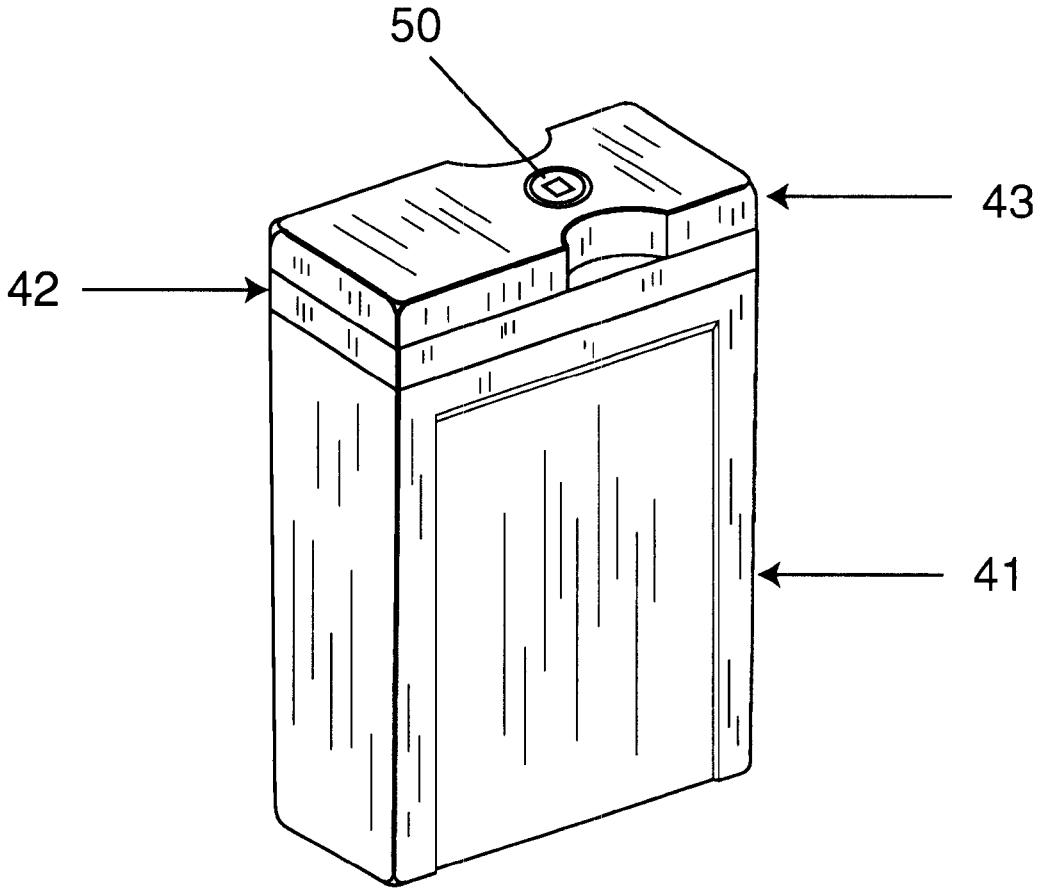
Figure 20:
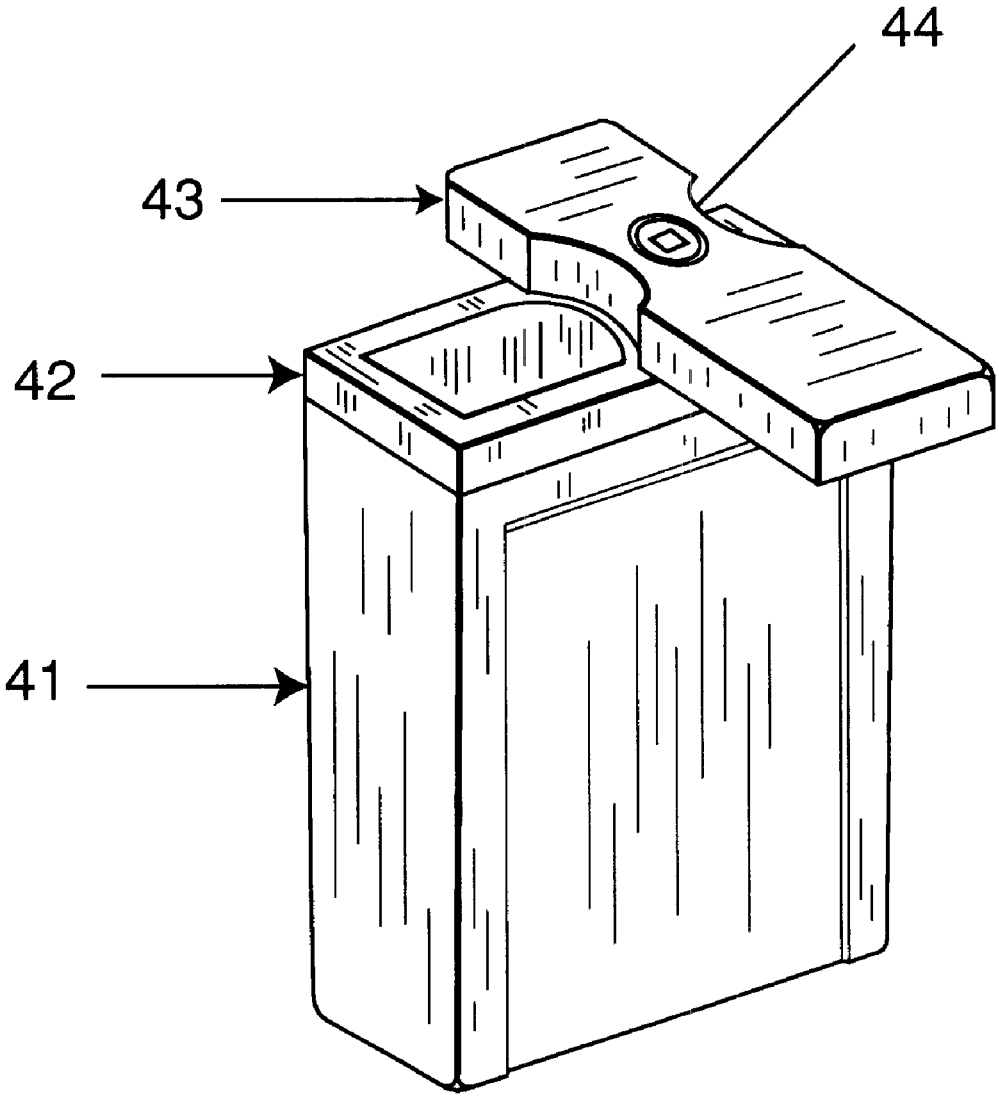
Figure 21:
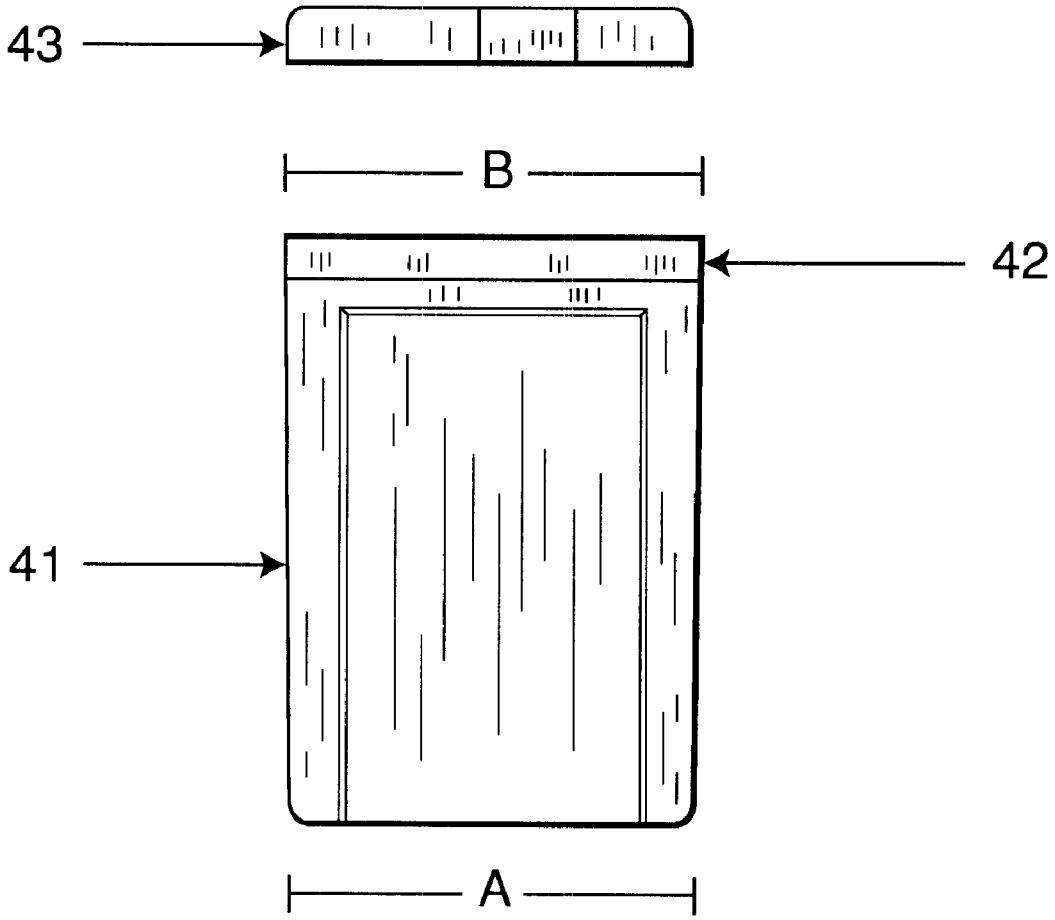
FIG. 21 is a front elevation of an alternative embodiment of the invention.
Figure 22:
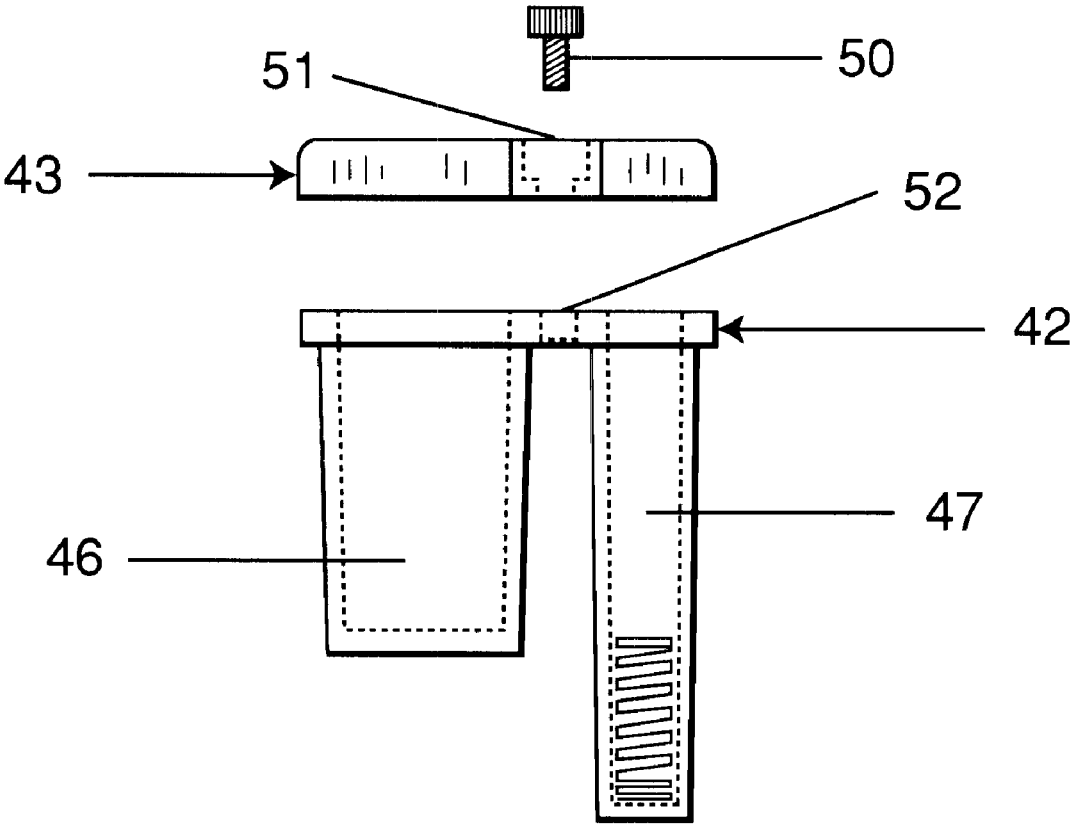
FIGS. 22 and 23 are front elevations of a lid and insert component of an alternative embodiment of the invention.
Figure 23:
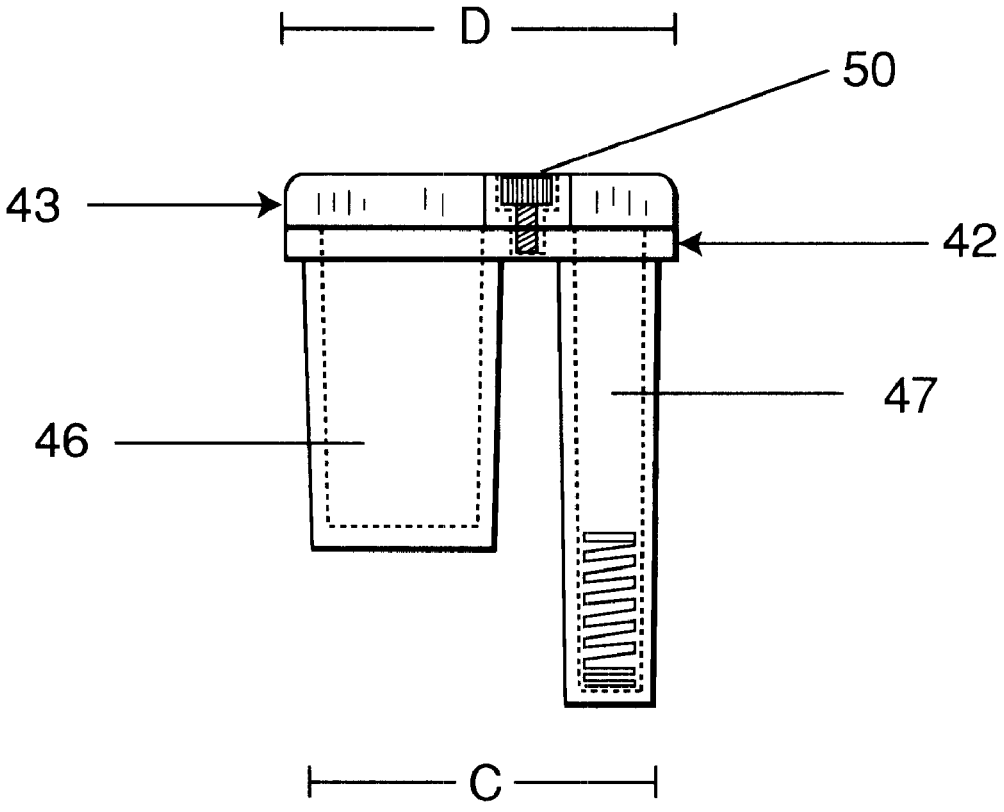

The smoking insert has a lip 10 which, as shown in FIGS. 7, 9, and 16, extends outwardly from openings 8 and 9. This lip preferably flares outwardly as shown in FIGS. 9 and 15 to a width and/or depth H which is larger than the internal dimensions of the body chambers 4 and 5 to facilitate seating of the insert onto the body as shown in FIG. 2 and upward retention of the insert. The insert can optionally be glued to the body.

Figure 5:
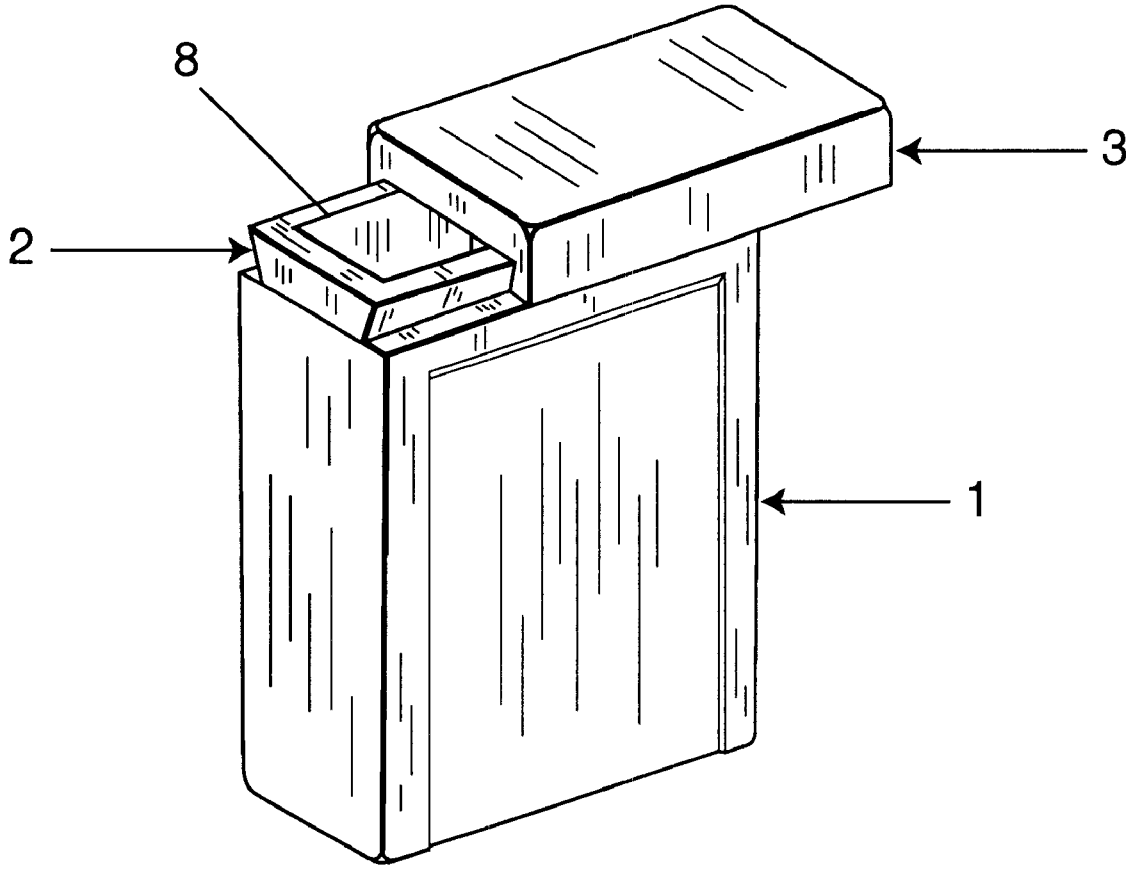
FIG. 5 is a perspective view of the invention with its lid in a first open position.
Figure 6:
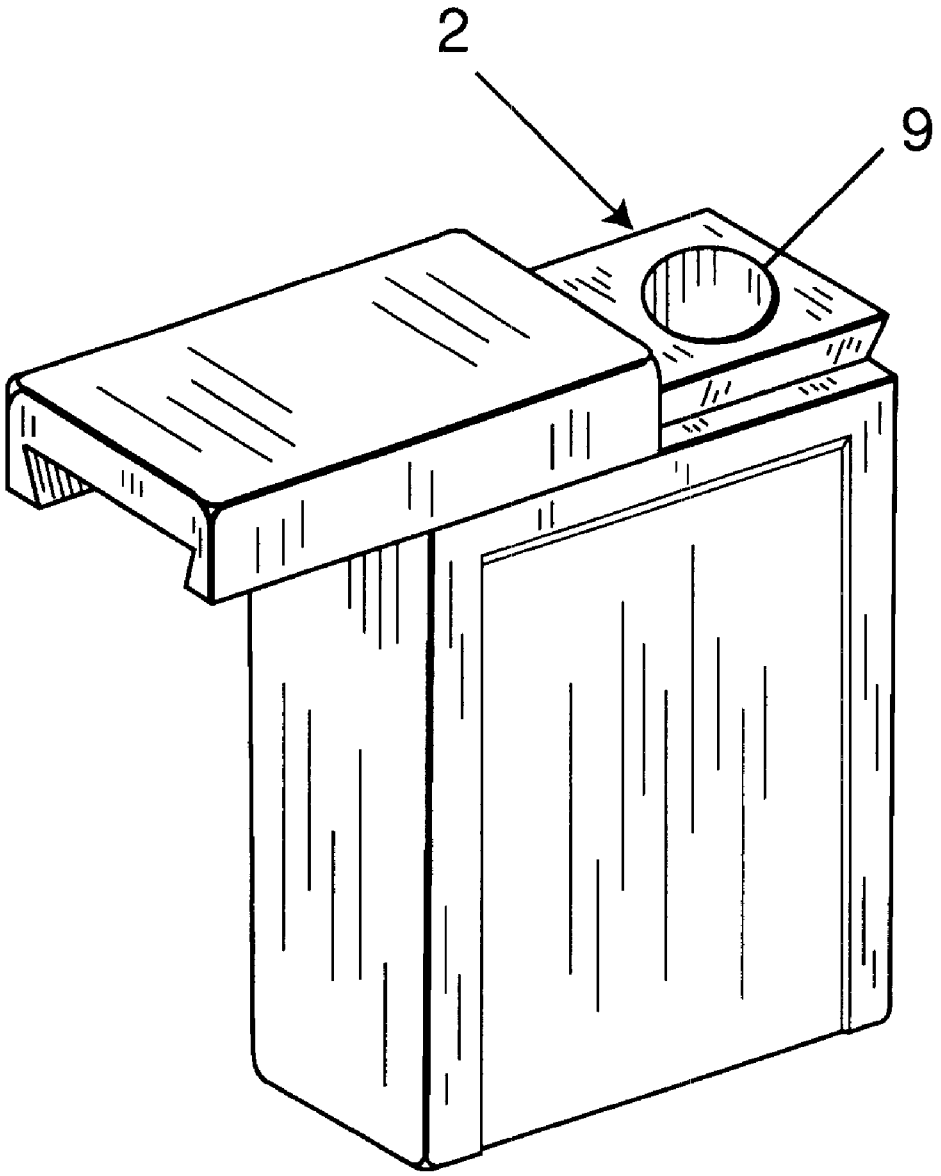
FIG. 6 is a perspective view of the invention with its lid in a second open position.

The smoking apparatus also preferably includes a lid 3 as shown in FIG. 9 which includes a pair of grippers 11 which mate with the flares on the insert lip 10. This feature inhibits upward removal of the lid from the insert while allowing the lid to be slid to one side as shown in FIG. 5 to provide access to the smoking material receptacle and to another side as shown in FIG. 6 to provide access to the pipe receptacle. The lid seals loose smoking material inside the smoking material receptacle and seals a pipe inside the pipe receptacle.

Figure 13:
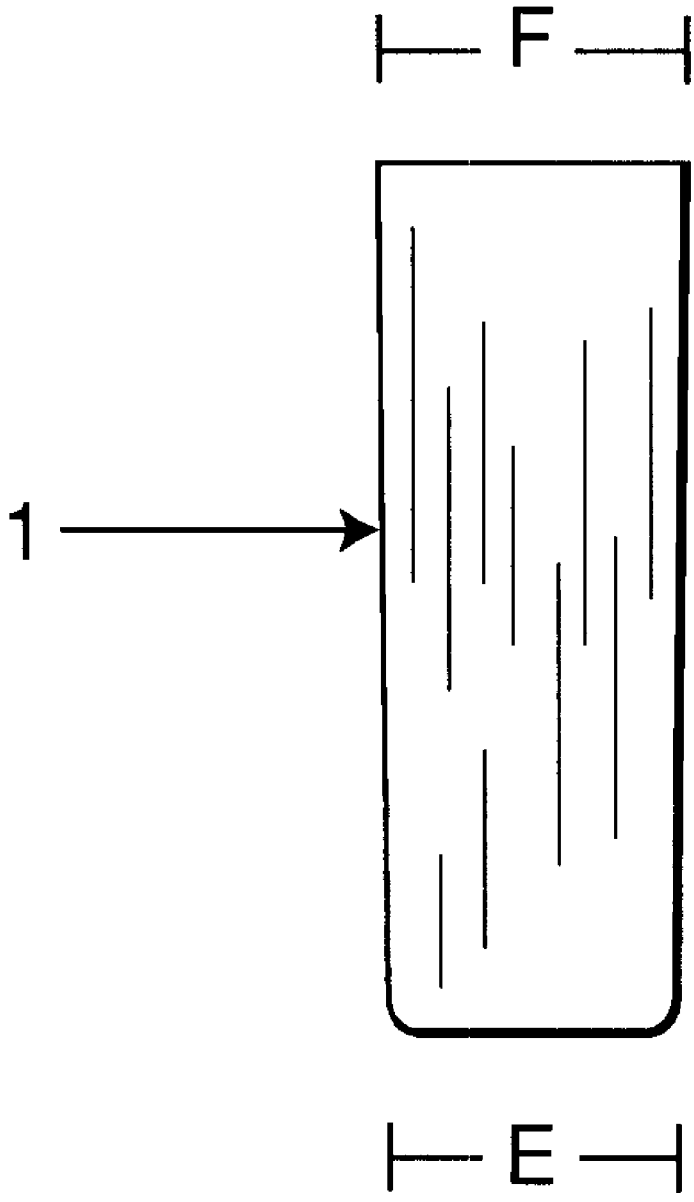
FIG. 13 is a left side elevation of the smoking apparatus body component of the invention.

From the bottom view of lid 3 presented in FIG. 13 it is evident the preferred embodiment includes detents 14 comprising raised projections, also illustrated in FIG. 9, which cooperate with receptacle openings 8 and 9 to register the lid in relative lateral position on insert 2.

As will be appreciated considering the apparatus with the lid applied as shown in FIG. 5, the insert optionally includes a spring 13 which serves to upwardly bias a pipe in the pipe receptacle against the lid. Upon sliding of the lid away from the pipe receptacle, the spring 13 presents the pipe above the upper edge of the pipe receptacle to facilitate grasping the pipe.

A pipe 38 (FIG. 16) having a bowl 39 on its end is filled with loose smoking material by tamping the bowl down into smoking material receptacle 6.

An alternative embodiment of the invention depicted in FIGS. 17 through 23 comprises smoking apparatus body 41, smoking insert 42, and lid 43. Insert 42 has smoking material receptacle 46 and pipe receptacle 47, preferably configured generally as described above in connection with the first preferred embodiment. Insert 42 and lid 43 have holes 52 and 51 for reception of screw 50 (FIGS. 22 and 23) to secure the lid to the insert. The lid, when applied to the insert seated in the body, is rotatable from a closed position shown in FIG. 19 to an open position shown in FIG. 20 to provide access to the smoking material receptacle and the pipe receptacle. Matching arcuate segments 44 on the lid correspond to the configuration of the receptacle openings.

The foregoing constructions have the further advantage that they comprise two pieces, a body and insert (or three pieces, if the lid is considered) of thin-walled (preferably, less than ⅛ inch) plastic material of consistent thickness and are therefore especially adaptable to standard plastic molding techniques. The consistent wall thickness facilitates uniform cooling after molding, thus reducing distortion. The relatively thin wall thickness keeps production cycle time short. Because the insert and the body are two separate pieces, there is void space between the two when the product is assembled. This feature avoids the product having a thick portion which is present in prior designs, and thus facilitates injection molding.

The floor of the smoking material receptacle is higher than the floor of the pipe receptacle, such that the smoking material receptacle is not as deep as the pipe receptacle. While the pipe receptacle is sufficiently deep to house the entire pipe, the smoking material receptacle is not. Thus the pipe is fully received in the pipe receptacle. When tamping the pipe bowl against the floor of the smoking material receptacle, the end of the pipe opposite the bowl projects well out of the smoking material receptacle, such that it is easy to grasp and manipulate.

In molding the apparatus, the interior surfaces and dimensions are determined by a core in a first half of a mold. The second half of the mold has reliefs in it that form the outer surfaces of the apparatus. The cores forming the interior surfaces of the insert and body are removed through the top openings of the insert and body. If the body and insert were molded as a single piece, the body would have to be bottomless to permit removal of a core required to form the external surfaces of the insert. Having the body be bottomless would render the part less sturdy and seemingly unfinished. By separately molding a body and an insert, the body can advantageously have a solid, flat bottom in combination with consistent wall thickness and a smoking material receptacle which is not as deep as the pipe receptacle. The apparatus is assembled by inserting the smoking insert into the smoking apparatus body at the upper end of the smoking apparatus body.

Although specific examples of the present invention and its application are set forth it is not intended that they are exhaustive or limiting of the invention. These illustrations and explanations are intended to acquaint others skilled in the art with the invention, its principles, and its practical application, so that others skilled in the art may adapt and apply the invention in its numerous forms, as may be best suited to the requirements of a particular use.

What is claimed is:

1. A smoking apparatus of the type having a space for holding loose smoking material and a separate space for holding an elongate smoking pipe, the apparatus comprising:

a smoking insert comprising a smoking material receptacle for holding said loose smoking material and a pipe receptacle for holding said elongate pipe;

the smoking material-receptacle having a smoking material receptacle opening at the top thereof, a solid smoking material-receptacle bottom, downwardly extending smoking material receptacle side walls, and a solid smoking material receptacle bottom;

the pipe receptacle having a pipe receptacle opening at the top thereof, a solid pipe receptacle bottom, and downwardly extending pipe receptacle side walls; and a smoking apparatus body for housing the insert, which body comprises a smoking apparatus body external surface, a smoking apparatus body upper end, and a smoking apparatus body lower end;

wherein the smoking apparatus body comprises a smoking apparatus body first chamber for receiving the smoking material receptacle, and a smoking apparatus body second chamber for receiving the pipe receptacle.

2. The smoking apparatus of claim 1 wherein the smoking insert further comprises a smoking insert lip adjacent the smoking material receptacle opening and wherein the smoking apparatus body comprises an upper rim for upwardly retaining the smoking insert lip when the smoking insert is inserted into said smoking apparatus body.

3. The smoking apparatus of claim 1, said smoking material receptacle side walls being tapered and having a width and depth to snugly fit within said first chamber for receiving said smoking material receptacle.

4. The smoking apparatus of claim 1, said pipe receptacle side walls being tapered and having a width and depth to snugly fit within said second chamber for receiving said pipe receptacle.

5. The smoking apparatus of claim 1 further comprising a lid for the smoking insert for sealing the smoking material receptacle and pipe receptacle.

6. The smoking apparatus of claim 5 wherein said lid is laterally slidable onto said smoking insert and comprises a gripper for inhibiting upward removal from said smoking insert.

7. The smoking apparatus of claim 5 wherein said lid is rotatable on said smoking insert to rotate between a closed position in which the smoking material receptacle and pipe receptacle are sealed and an open position in which access is provided to the smoking material receptacle and the pipe receptacle.

8. The smoking material receptacle of claim 7 in which the lid comprises at least one arcuate segment which generally corresponds to the shape of one of said smoking material receptacle opening and pipe receptacle opening.

9. A smoking apparatus of the type having a space for holding loose smoking material and a separate space for holding an elongate smoking pipe, the apparatus comprising:

a smoking insert comprising a smoking material receptacle for holding said loose smoking material and a pipe receptacle for holding said elongate pipe;

the smoking material receptacle having a smoking material receptacle opening at the top thereof, downwardly extending smoking material receptacle side walls, and a solid smoking material receptacle bottom;

the pipe receptacle having a pipe receptacle opening at the top thereof, a solid pipe receptacle bottom, and downwardly extending pipe receptacle side walls; and a smoking apparatus body molded as a component separate from the smoking insert comprising a smoking apparatus body external surface, a smoking apparatus body upper end with an upwardly facing upper rim, and a smoking apparatus body lower end;

wherein the smoking insert comprises a smoking insert lip adjacent the smoking material receptacle opening which lip is seated against said upwardly facing upper rim when the smoking insert is inserted into the smoking apparatus body.

10. A smoking apparatus of the type having a space for holding loose smoking material and a separate space for holding an elongate smoking pipe, the apparatus comprising:

a-smoking insert comprising a smoking material receptacle for holding said loose smoking material and a pipe receptacle for holding said elongate pipe;

the smoking material receptacle having a smoking material receptacle opening at the top thereof, downwardly extending smoking material receptacle side walls, and a solid smoking material receptacle bottom;

the pipe receptacle having a pipe receptacle opening at the top thereof, a solid pipe receptacle bottom, downwardly extending pipe receptacle side walls, and a solid pipe receptacle bottom; and a smoking apparatus body comprising a smoking apparatus body external surface, a smoking apparatus body upper end, a smoking apparatus body lower end, a smoking apparatus body first chamber for receiving the smoking material receptacle, and a smoking apparatus body second chamber for receiving the pipe receptacle;

wherein said smoking material receptacle side walls are tapered and have a width and depth to snugly fit the insert within said second chamber for receiving said pipe receptacle.

11. A smoking apparatus of the type having a space for holding loose smoking material and a separate space for holding an elongate smoking pipe, the apparatus comprising:

a smoking insert comprising a smoking material receptacle for holding said loose smoking material and a pipe receptacle for holding said elongate pipe;

the smoking material receptacle having a smoking material receptacle opening at the top thereof, downwardly extending smoking material receptacle side walls, and a solid smoking material receptacle bottom;

the pipe receptacle having a pipe receptacle opening at the top thereof, a solid pipe receptacle bottom, downwardly extending pipe receptacle side walls, and a solid pipe receptacle bottom; and a smoking apparatus body comprising a smoking apparatus body external surface, a smoking apparatus body upper end, a smoking apparatus body lower end, a smoking apparatus body first chamber for receiving the smoking material receptacle, and a smoking apparatus body second chamber for receiving the pipe receptacle, wherein said smoking apparatus body first chamber and said smoking apparatus second chamber are tapered from said smoking apparatus body upper end to said smoking apparatus body lower end.

* * * * *